US009610594B2

(12) United States Patent
Chan

(10) Patent No.: US 9,610,594 B2
(45) Date of Patent: Apr. 4, 2017

(54) SHOWERHEAD WITH MODE SWITCHING MEMBER

(71) Applicant: Jason Siu Ming Chan, Kowloon Bay (HK)

(72) Inventor: Jason Siu Ming Chan, Kowloon Bay (HK)

(73) Assignee: AQUAmate Sanitary Ware Europe Ltd, Kowloon (HK)

( * ) Notice: Subject to any disclaimer, the term of this patent is extended or adjusted under 35 U.S.C. 154(b) by 0 days.

(21) Appl. No.: 14/723,454

(22) Filed: May 28, 2015

(65) Prior Publication Data

US 2015/0343463 A1 Dec. 3, 2015

(30) Foreign Application Priority Data

May 30, 2014 (CN) ..... 2014 2 0285488 U
May 30, 2014 (CN) ..... 2014 2 0285644 U

(51) Int. Cl.

*B05B 3/00* (2006.01)
*B05B 1/16* (2006.01)
*B05B 1/18* (2006.01)
*B05B 3/04* (2006.01)

(52) U.S. Cl.

CPC ..... *B05B 1/1636* (2013.01); *B05B 1/18* (2013.01); *B05B 3/04* (2013.01)

(58) Field of Classification Search

CPC ..... B05B 1/16; B05B 1/1636; B05B 1/1645
USPC ..... 239/436–449
See application file for complete search history.

(56) References Cited

U.S. PATENT DOCUMENTS 5,316,216 A * 5/1994 Cammack ..... B05B 1/1636 239/381
5,518,181 A * 5/1996 Shames ..... B05B 1/1609 239/381
8,708,257 B2 * 4/2014 Gautschi ..... B05B 1/1681 239/525
8,881,993 B2 * 11/2014 Lev ..... B05B 1/1636 239/394
2014/0110502 A1 * 4/2014 Yu ..... B05B 1/18 239/240
2014/0319247 A1 * 10/2014 Zhou ..... B05B 15/067 239/442

* cited by examiner

*Primary Examiner* — Arthur O Hall
*Assistant Examiner* — Viet Le

(57) ABSTRACT

The present invention is a showerhead with mode switching member including a water inlet, a water passage member, a primary water diverting member, a mode switching member, a secondary water diverting member and a cover plate. The mode switching member is rotatably disposed between the water passage member and the primary water diverting member to selectively block water from the water passage orifices of the water passage member from passing through at least one of the primary water diverting orifices of the primary water diverting member. The mode switching member may comprise a turbine and an eccentric wheel, or an arc-shaped water stopping plastic member.

7 Claims, 8 Drawing Sheets

SHOWERHEAD WITH MODE SWITCHING MEMBER

BACKGROUND OF THE INVENTION

The present invention relates to a showerhead and more particularly pertains to a showerhead with mode switching member.

Showerheads are one of the most commonly used devices in daily life, such as for showers. A traditional showerhead generally comprises a body and a cover plate. Water passageways run through the body. The body comprises a handle portion and a head portion. Water passageways run from a rear end of the handle portion to the head portion. The handle portion is mainly for users to grip. The cover plate is rotatably mounted on the head portion. When the cover plate rotates in relation to the head portion, the water discharge pathways and water discharge directions between the cover plate and the head portion are changed, thereby forming different water discharge sprays. During shower, water sprays of different force levels from the showerhead could perform specialized massages to different body parts. Depending on different discharge sprays, the massage modes of a showerhead may be classified as powerful, soft and moderate.

Existing showerheads could only maintain single water discharge mode during use but fail to automatically switch water discharge modes continuously or to combine different water discharge modes, thus incapable of offering the comfortable shower experience of having various sprays directing to the user's body alternatively. Users thus fail to enjoy the massage experience brought by different sprays. Besides, water discharge of traditional showerheads is continuous, thus users fail to adjust force levels of the water sprays by sensing the impact of the water sprays on the body.

BRIEF SUMMARY OF THE INVENTION

In view of the aforesaid disadvantages now present in the prior art, the present invention provides a showerhead with mode switching member which achieves automatic switching of spray modes continuously or combining spray modes.

To attain this, the present invention generally comprises:

a water inlet;

a water passage member with a plurality of water passage orifices which are in water communication with the water inlet;

a primary water diverting member with a plurality of primary water diverting orifices;

a mode switching member rotatably disposed between the water passage member and the primary water diverting member to selectively block water from the water passage orifices of the water passage member from passing through at least one of the primary water diverting orifices of the primary water diverting member;

a secondary water diverting member with a plurality of secondary water diverting orifices, each of which is in water communication with a different one of the primary water diverting orifices of the primary water diverting member respectively; and a cover plate divided into a plurality of water discharge areas, each of which is disposed with a plurality of nozzles and is in water communication with a different one of the secondary water diverting orifices of the secondary water diverting member.

The water passage orifices are each slanted to a same angle, so that water from the water inlet enters a mode switching member receiving space defined between the water passage member and the primary water diverting member as a slanted water jet to effect rotation of the mode switching member.

A water chamber headed by a primary water diverting orifice is defined by space occupied by water flowing from the primary water diverting orifices to the corresponding secondary water diverting orifice to the corresponding water discharge area, and all water chambers, each headed by one of the plurality of the primary water diverting orifices, have same volume.

In one embodiment, the mode switching member comprises a turbine and an eccentric wheel securely engaged and configured to rotate with the turbine relative to the water passage member and the primary water diverting member; a bottom side of the eccentric wheel abuts against and rotates relative to the primary water diverting member; the eccentric wheel is disposed with an arc-shaped slot which allows water flow from the water passage orifices to one or more of the primary water diverting orifices of the primary water diverting member. The turbine is disposed with a connecting portion, and the eccentric wheel is disposed with a connecting hole for receiving the connecting portion of the turbine; a pin is disposed inside the connecting portion for connecting the turbine and the eccentric wheel. The eccentric wheel is an eccentric gear wheel; the eccentric gear wheel is partially engaged with an internal gear so as to regulate rotation speed of the eccentric wheel. The eccentric gear wheel and the internal gear have same gear ratio.

In one embodiment, the mode switching member comprises an arc-shaped water stopping plastic member movable along an annular slot defined between the water passage member and the first water diverting member.

In one embodiment, there are three water passage orifices arranged annually and evenly distributed on the water passage member. The primary water diverting member is annually and evenly disposed with a first primary water diverting orifice, a second primary water diverting orifice and a third primary water diverting orifice; the secondary water diverting member is disposed with a first secondary water diverting orifice, a second secondary water diverting orifice and a third secondary water diverting orifice; the first primary water diverting orifice is in water communication with the first secondary water diverting orifice; the second primary water diverting orifice is in water communication with the second secondary water diverting orifice; the third primary water diverting orifice is in water communication with the third secondary water diverting orifice; the cover plate is disposed with a first water discharge area, a second water discharge area and a third water discharge area; the nozzles in the first water discharge area are all in water communication with the first secondary water diverting orifice of the secondary water diverting member; the nozzles in the second water discharge area are all in water communication with the second secondary water diverting orifice of the secondary water diverting member; the nozzles in the third water discharge area are all in water communication with the third secondary water diverting orifice of the secondary water diverting member. The arc-shaped slot of the eccentric wheel or the arc-shaped water stopping plastic member is sized sufficient to cover two of the three primary water diverting orifices.

In one embodiment, the water passage member is disposed with a sealing ring at its outer periphery.

In one embodiment, the secondary water diverting member is disposed with a sealing ring at its outer periphery.

The present invention essentially separates the space in the showerhead into a plurality of separate water chambers. As an example, the first water chamber corresponds to the water path from the first water passage orifice to the first primary water diverting orifice to the first secondary water diverting orifice to the first water discharge area. By means of the mode switching member, at least one of the water chambers is deactivated (i.e. by blocking water from passing through the water passage orifice to the primary water diverting orifice of the relevant water chamber). In the case when the mode switching member is driven by water flow from the water passage orifices to rotate rapidly and continuously, even though only at least one of the water chambers is deactivated at a particular moment, the deactivation is shortly shifted to another water chamber and thus user feels a rich spray as if there is no deactivation of any water chamber. As the deactivated water chamber substantially does not consume any water, the present invention can achieve water saving effects while maintaining the same rich spray experience for users. On the other hand, in the case when the mode switching member is driven by water flow from the water passage orifices to rotate continuously and less rapidly, users could enjoy comfortable shower experience brought by various alternating sprays and adjust force level of water sprays; massage experience brought by sprays impacting the body could be enhanced.

DETAILED DESCRIPTION OF THE INVENTION

Figure 1:
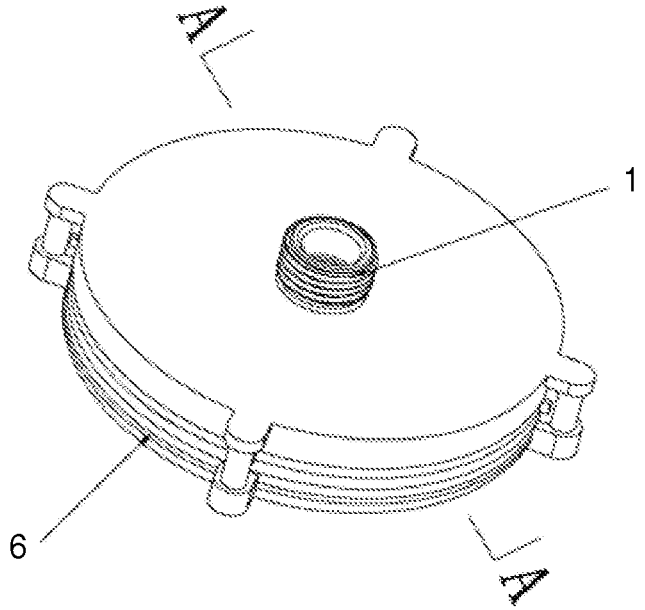
FIG. 1 is a perspective view of a first embodiment of the present invention.
Figure 2:
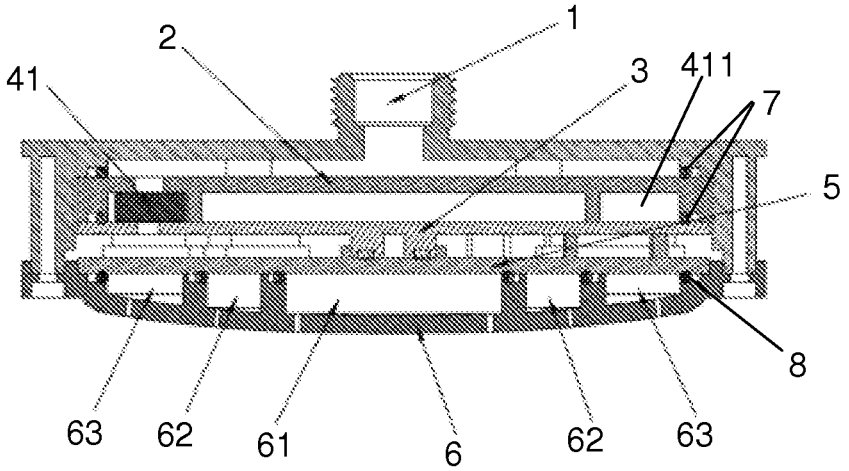
FIG. 2 is a cross sectional view of the first embodiment of the present invention along A-A in FIG. 1.
Figure 3:
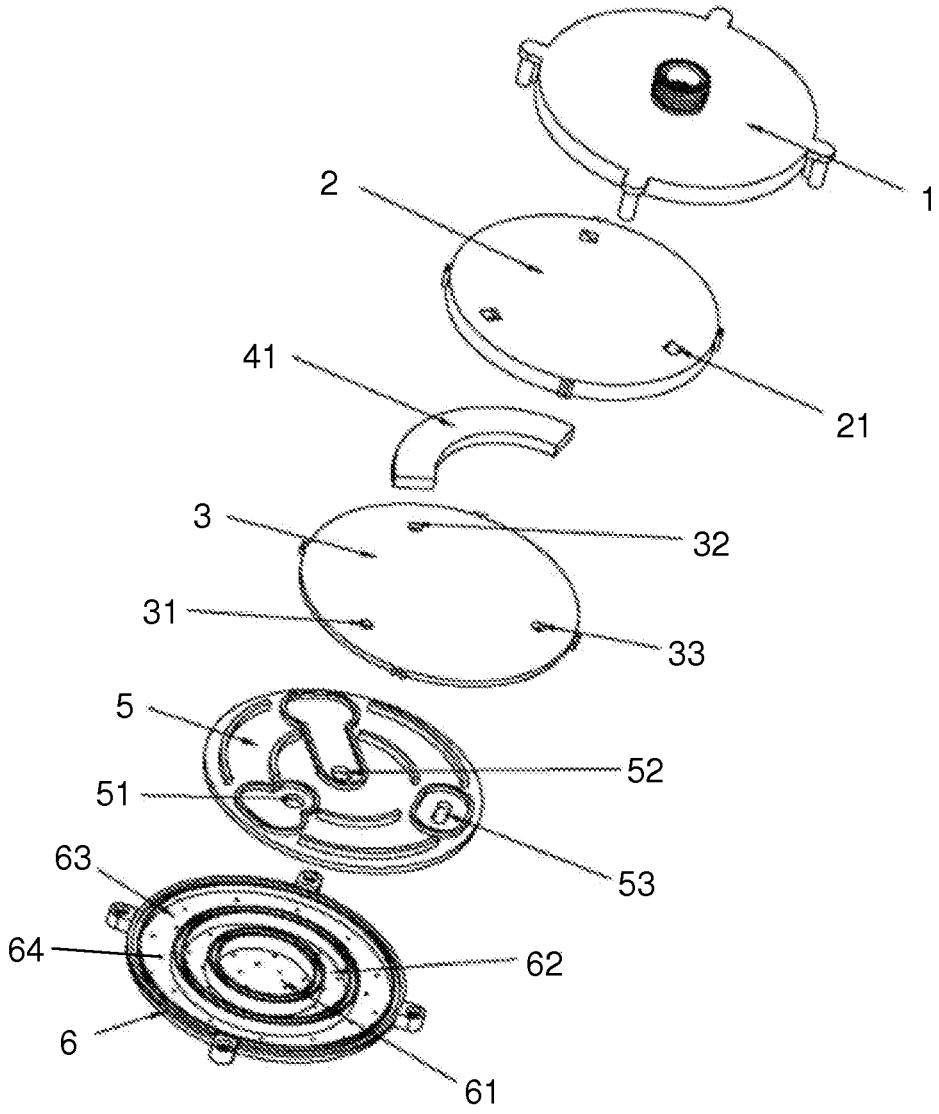
FIG. 3 is a disassembling view of the first embodiment of the present invention.
Figure 4:
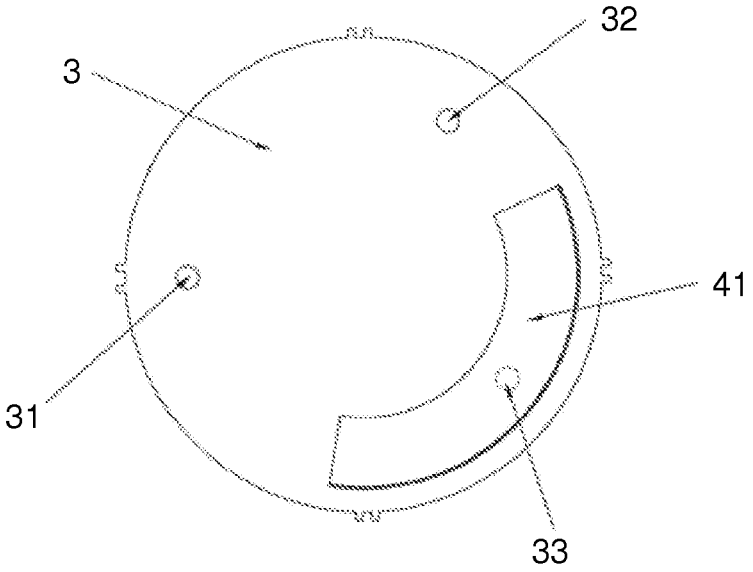
FIG. 4 is a top view of the arc-shaped water stopping plastic member and the primary water diverting member of the first embodiment of the present invention.
Figure 5:
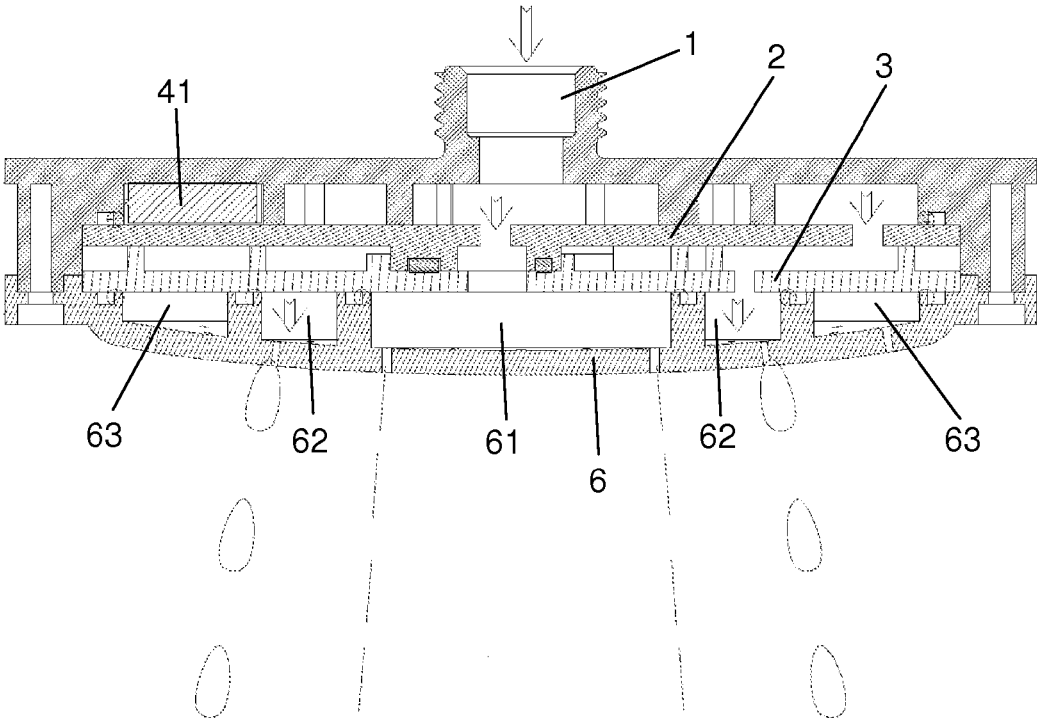
FIG. 5 is a sectional view of the first embodiment of the present invention with the mode switching member at a first position.
Figure 6:
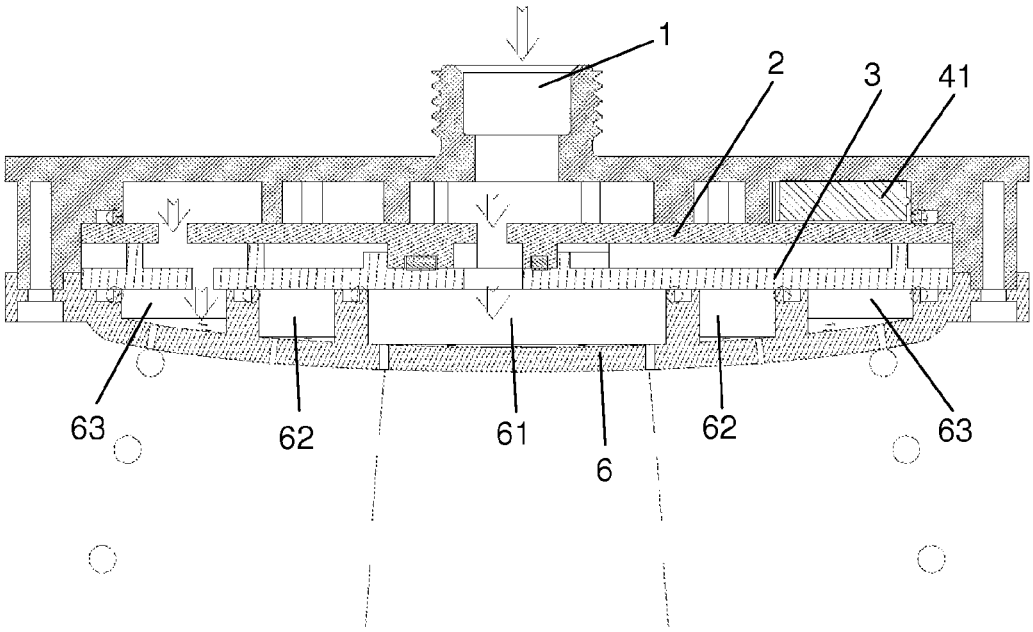
FIG. 6 is a sectional view of the first embodiment of the present invention with the mode switching member at a second position.
Figure 7:
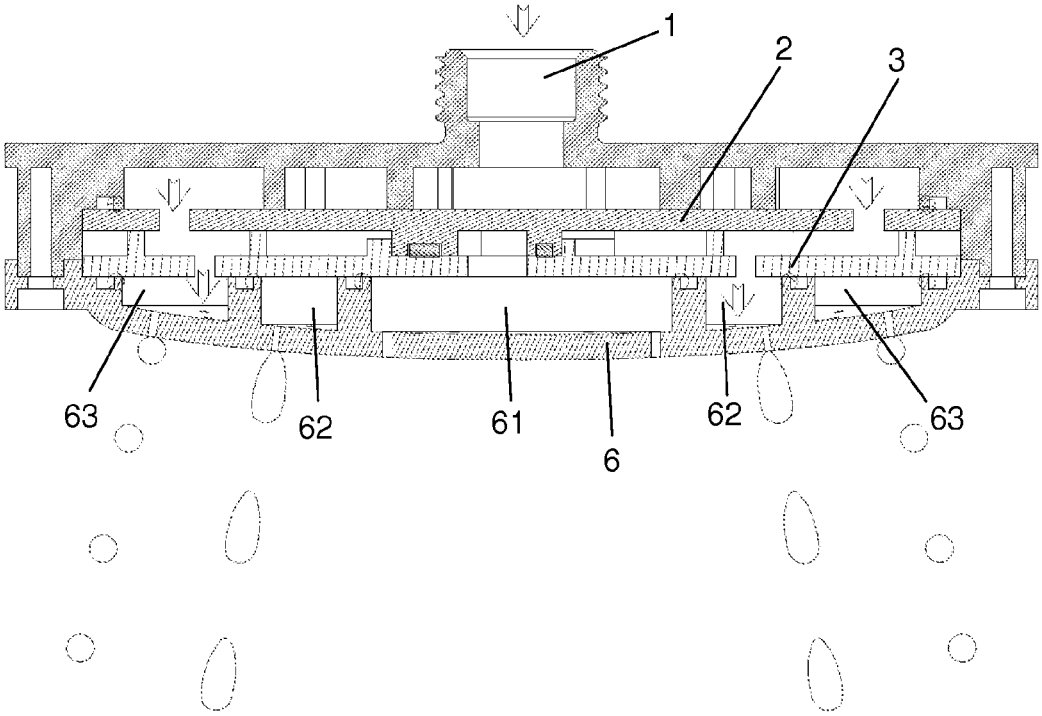
FIG. 7 is a sectional view of the first embodiment of the present invention with the mode switching member at a third position.

As illustrated in FIGS. 1 to 7, a first embodiment of the present invention comprises a water inlet 1, a water passage member 2, a primary water diverting member 3, a mode switching member which comprises an arc-shaped water stopping plastic member 41, a secondary water diverting member 5 and a cover plate 6. The water passage member 2 is disposed with three water passage orifices 21 which are in water communication with the water inlet 1. The three water passage orifices 21 are arranged annually and evenly distributed on the water passage member 2. The water passage orifices 21 are each slanted to a same angle, so that water from the water inlet 1 enters a mode switching member receiving space defined between the water passage member 2 and the primary water diverting member 3 as a slanted water jet to effect rotation of the mode switching member which comprises the arc-shaped water stopping plastic member 41. The primary water diverting member 3 is annually and evenly disposed with three primary water diverting orifices, namely a first primary water diverting orifice 31, a second primary water diverting orifice 32 and a third primary water diverting orifice 33. The mode switching member comprising the arc-shaped water stopping plastic member 41 is sized sufficient to cover two of the three primary water diverting orifices 31, 32, 33, and is rotatably disposed between the water passage member 2 and the primary water diverting member 3 to selectively block water from the water passage orifices 21 of the water passage member 2 from passing through at least one of the primary water diverting orifices 31, 32, 33 of the primary water diverting member 3. More particularly, the mode switching member comprising the arc-shaped water stopping plastic member 41 is movable along an annular slot 411 defined between the water passage member 2 and the first water diverting member 3. The secondary water diverting member 5 is disposed with three secondary water diverting orifices, namely a first secondary water diverting orifice 51, a second secondary water diverting orifice 52 and a third secondary water diverting orifice 53, each of which is in water communication with a different one of the primary water diverting orifices 31, 32, 33 of the primary water diverting member 3 respectively. In other words, the first primary water diverting orifice 31 is in water communication with the first secondary water diverting orifice 51; the second primary water diverting orifice 32 is in water communication with the second secondary water diverting orifice 52; the third primary water diverting orifice 33 is in water communication with the third secondary water diverting orifice 53. The cover plate 6 is divided into three water discharge areas, namely a first water discharge area 61, a second water discharge area 62 and a third water discharge area 63, each of which is disposed with a plurality of nozzles 64 and is in water communication with a different one of the secondary water diverting orifices 51, 52, 53 of the secondary water diverting member 5. In other words, the nozzles 64 in the first water discharge area 61 are all in water communication with the first secondary water diverting orifice 51 of the secondary water diverting member 5; the nozzles 64 in the second water discharge area 62 are all in water communication with the second secondary water diverting orifice 52 of the secondary water diverting member 5; the nozzles 64 in the third water discharge area 63 are all in water communication with the third secondary water diverting orifice 53 of the secondary water diverting member 5. A water chamber headed by a primary water diverting orifice 31, 32, 33 is defined by space occupied by water flowing from the primary water diverting orifices 31, 32, 33 (e.g. the first primary water diverting orifice 31) to the corresponding secondary water diverting orifice 51, 52, 53 (e.g. the first secondary water diverting orifice 51) to the corresponding water discharge area 61, 62, 63 (e.g. the first water discharge area 61). In other words, there are three water chambers in this embodiment, and all three water chambers have same volume. The water passage member 2 is disposed with a sealing ring 7 at its outer periphery, and the secondary water diverting member 5 is disposed with a sealing ring 8 at its outer periphery to prevent water leakage.

The present embodiment operates as follows: water enters the showerhead via the water inlet 1 and then passes through the water passage orifices 21 as three slanted water jets. The three slanted water jets pushes the arc-shaped water stopping plastic member 41 to rotate continuously, so that the arc-shaped water stopping plastic member 41 blocks water from the water passage orifices 21 from passing through one of the primary water diverting orifices 31, 32, 33 at any given moment. The secondary water diverting orifice and the water discharge area which correspond to the blocked primary water diverting orifice 31, 32, 33 therefore do not receive any water input and thus there would be no water discharging from the nozzles of that water discharge area.

Figure 8:
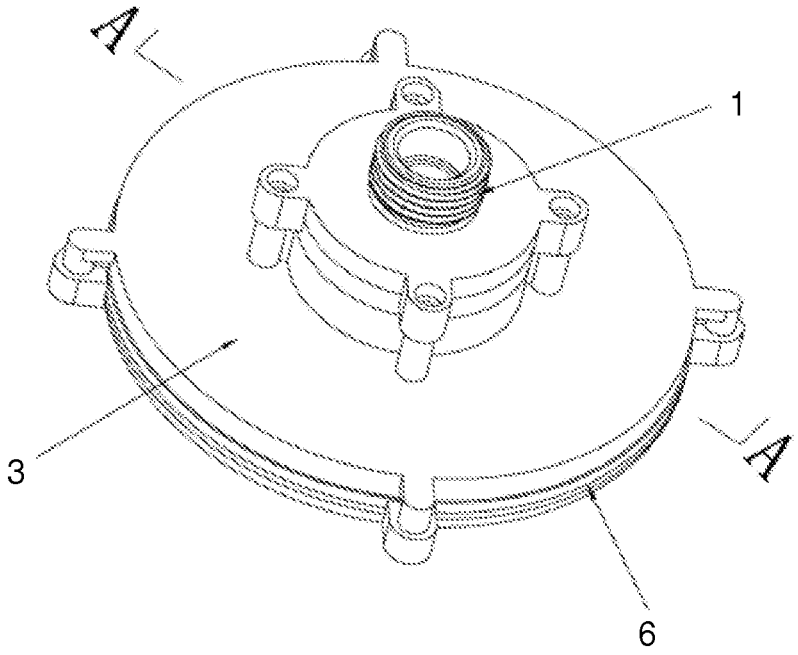
FIG. 8 is a perspective view of a second embodiment of the present invention.
Figure 9:
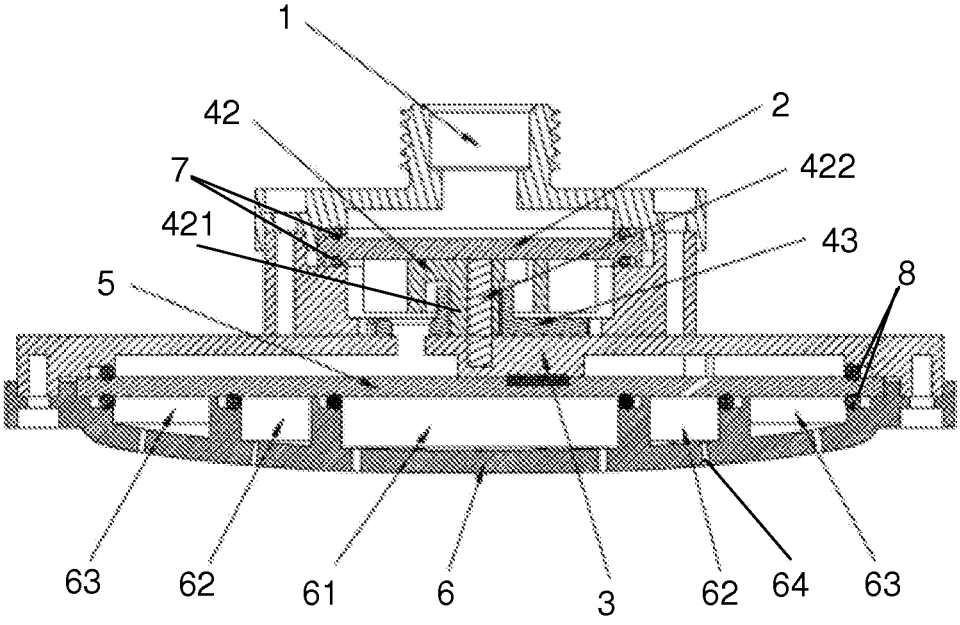
FIG. 9 is a cross sectional view of the second embodiment of the present invention along A-A in FIG. 8.
Figure 10:
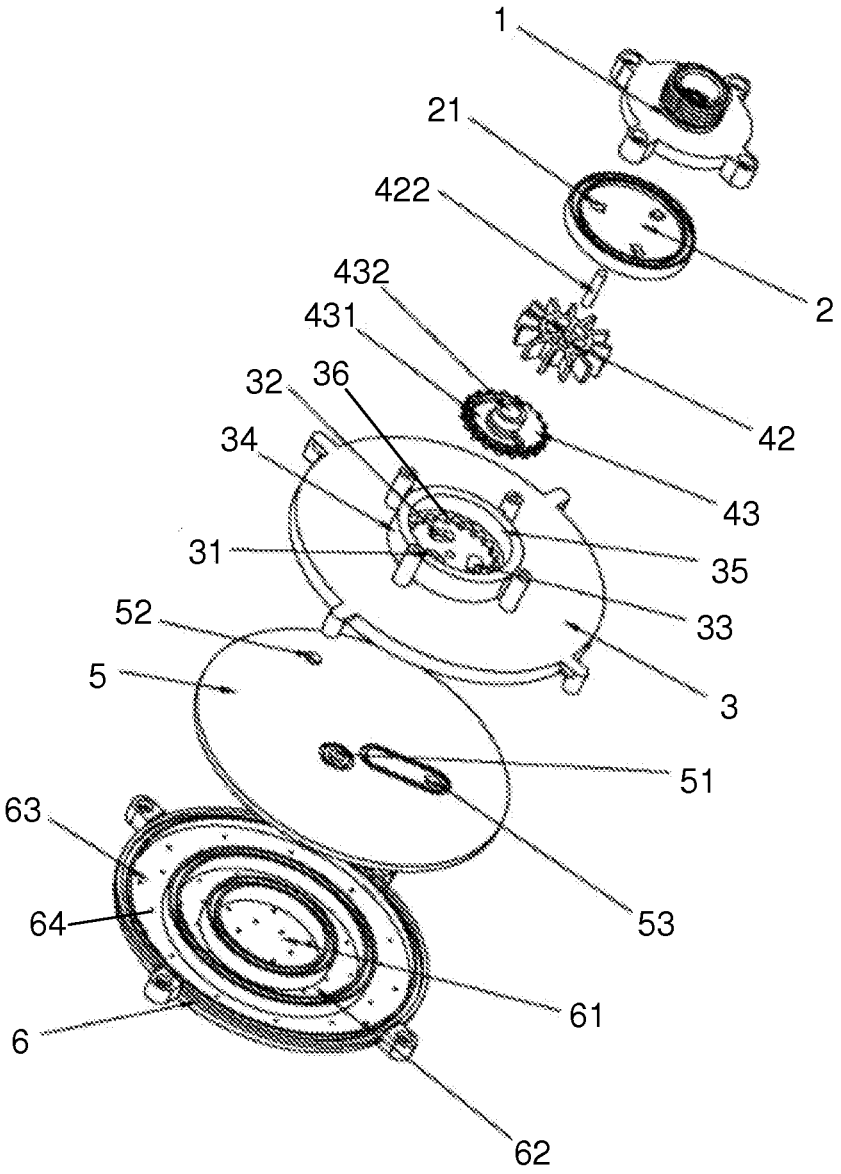
FIG. 10 is a disassembling view of the second embodiment of the present invention.
Figure 11:
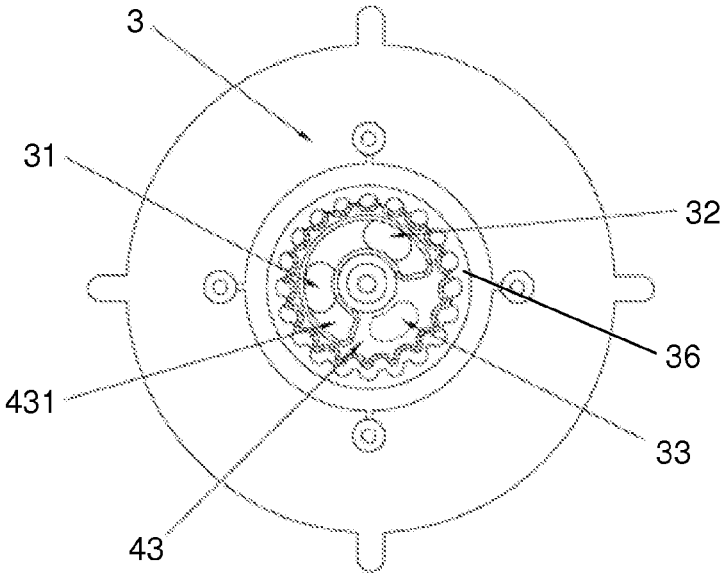
FIG. 11 is a top view of the eccentric wheel and the primary water diverting member of the second embodiment of the present invention.
Figure 12:
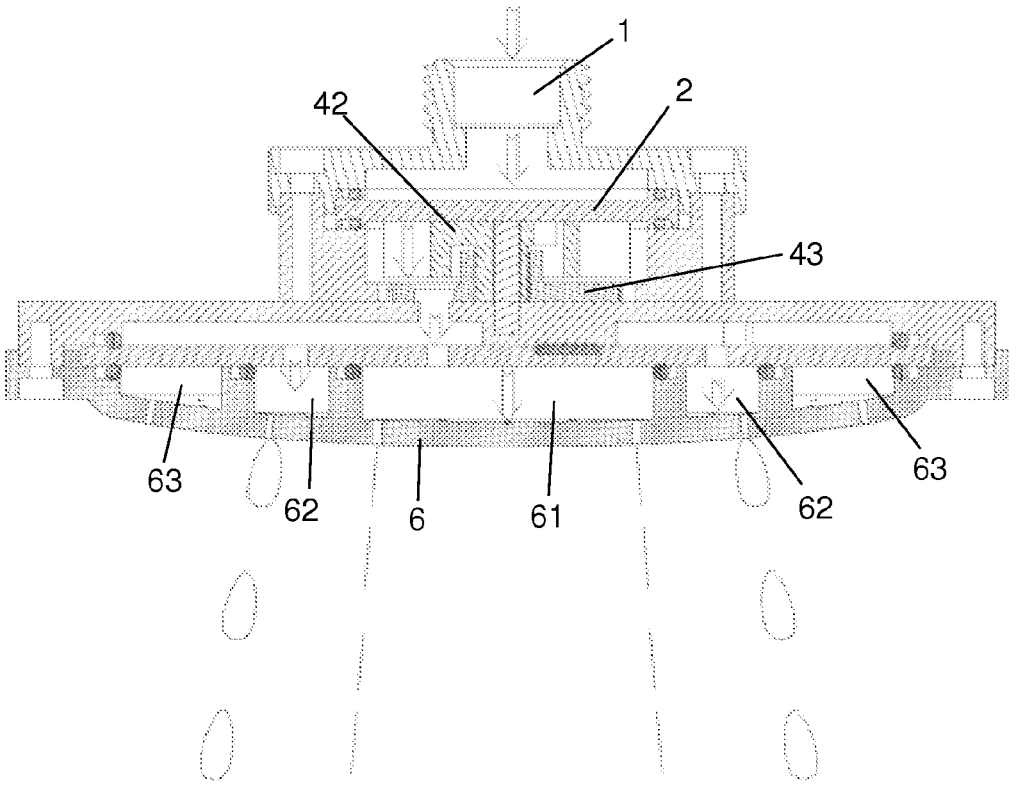
FIG. 12 is a sectional view of the second embodiment of the present invention with the mode switching member at a first position.
Figure 13:
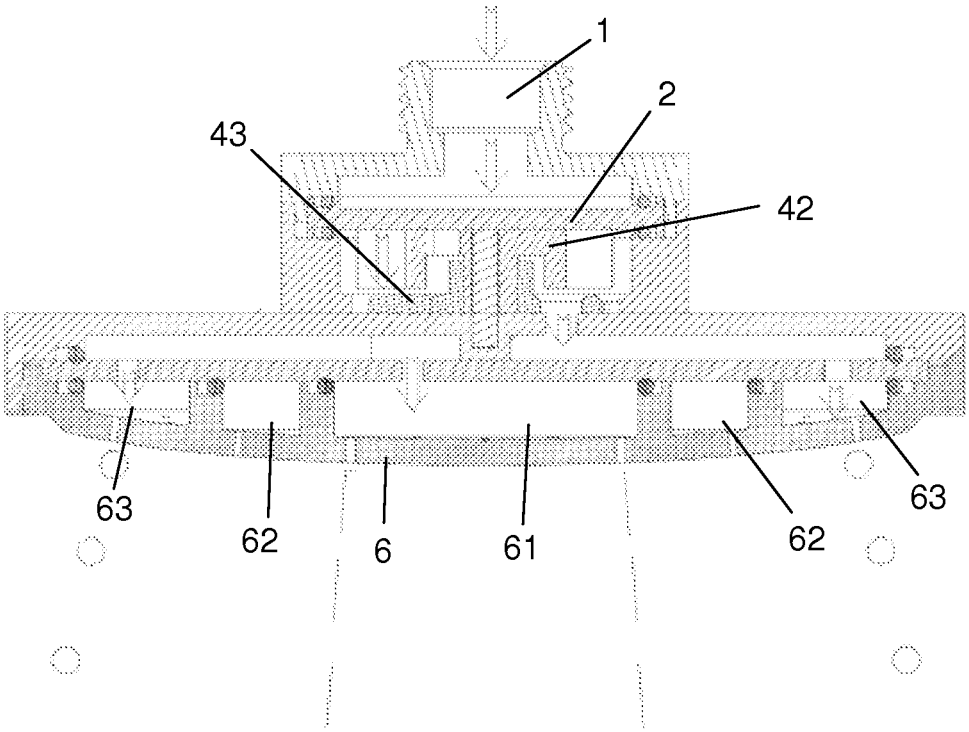
FIG. 13 is a sectional view of the second embodiment of the present invention with the mode switching member at a second position.
Figure 14:
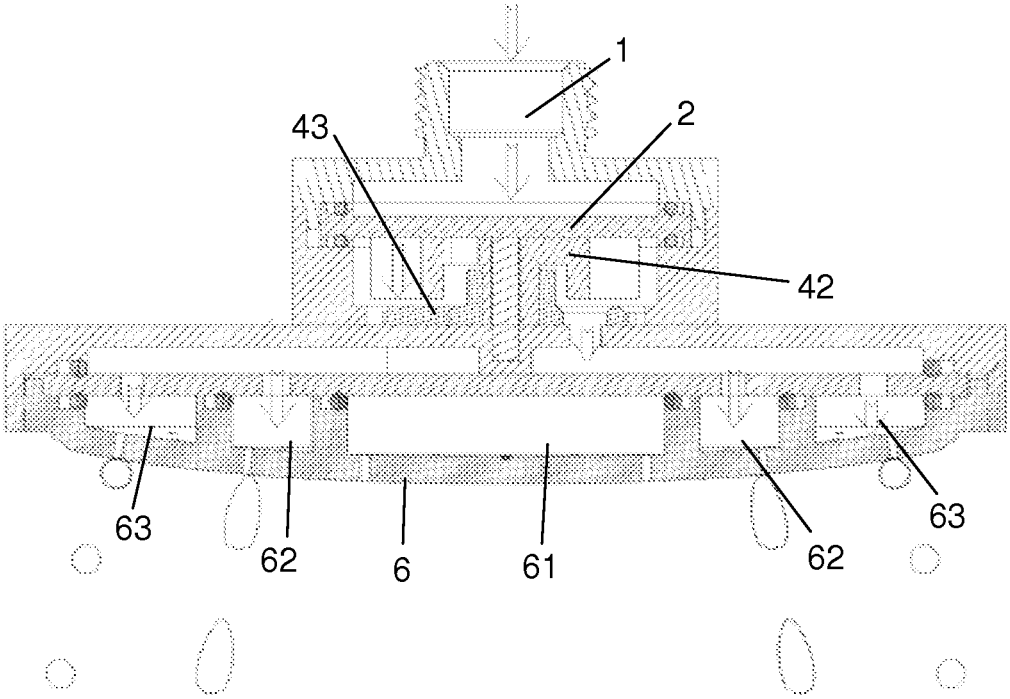
FIG. 14 is a sectional view of the second embodiment of the present invention with the mode switching member at a third position.

FIGS. 8 to 14 illustrate a second embodiment of the present invention. The second embodiment is substantially the same as the first embodiment except for the following features, and so the details are not repeated herein. In the second embodiment, the mode switching member comprises a turbine 42 and an eccentric wheel 43. In this embodiment, the primary diverting member 3 is disposed with a tubular wall 34 within which defines a receiving space 35 for receiving the turbine 42 and the eccentric wheel 43. The tubular wall 34 abuts against the water inlet 1. The first primary water diverting orifice 31, the second primary water diverting orifice 32 and a third primary water diverting orifice 33 are disposed within the area within the tubular wall 34. The mode switching member comprising the turbine 42 and the eccentric wheel 43 is rotatably disposed between the water passage member 2 and the primary water diverting member 3 within the receiving space 35 to selectively block water from the water passage orifices 21 of the water passage member 2 from passing through at least one of the primary water diverting orifices 31, 32, 33 of the primary water diverting member 3. The eccentric wheel 43 is securely engaged and configured to rotate with the turbine 41. The turbine 42 and the eccentric wheel 43 rotate relative to the water passage member 2 and the primary water diverting member 3. A bottom side of the eccentric wheel 43 abuts against and rotates relative to the primary water diverting member 3. The eccentric wheel 43 is disposed with an arc-shaped slot 431 which is sized sufficient to cover two of the three primary water diverting orifices 31, 32, 33, so as to allow water flow from the water passage orifices 21 to two of the primary water diverting orifices 31, 32, 33 of the primary water diverting member 3. The turbine 42 is disposed with a connecting portion 421, and the eccentric wheel 43 is disposed with a connecting hole 432 for receiving the connecting portion 421 of the turbine 42; a pin 422 is disposed inside the connecting portion 421 for connecting the turbine 42 and the eccentric wheel 43. As the turbine 42 is relatively small in size and thus needs only a very short period of time to rotate 360 degrees, the eccentric wheel 43 also serves to lower the rotation speed so that the time period for the eccentric wheel 43 to cover a specific primary water diverting orifice 31, 32, 33 would not be too short. More particularly, the eccentric wheel 43 is an eccentric gear wheel; the eccentric gear wheel 43 is partially engaged with an internal gear 36 disposed at the bottom of the receiving space 35 so as to regulate rotation speed of the eccentric wheel 43. The portion of the eccentric wheel 43 which engages with the internal gear 36 is directed by the internal gear 36 to move for the distance of one tooth each time. If there is no such gear mechanism, the turbine 42 will drive the eccentric wheel 43 to move continuously and rapidly. The eccentric gear wheel 43 and the internal gear 36 have same gear ratio.

The above embodiments are preferred embodiments of the present invention. The present invention is capable of other embodiments and is not limited by the above embodiments. Any other variation, decoration, substitution, combination or simplification, whether in substance or in principle, not deviated from the spirit of the present invention, is replacement or substitution of equivalent effect and falls within the scope of protection of the present invention.

What is claimed is:

1. A showerhead, which comprises a water inlet;

a water passage member with a plurality of water passage orifices which are in water communication with the water inlet;

a primary water diverting member with a plurality of primary water diverting orifices:

a mode switching member rotatably disposed between the water passage member and the primary water diverting member to selectively block water from the water passage orifices of the water passage member from passing through at least one of the primary water diverting orifices of the primary water diverting member;

a secondary water diverting member with a plurality of secondary water diverting orifices, each of which is in water communication with a different one of the primary water diverting orifices of the primary water diverting member respectively; and a cover plate divided into a plurality of water discharge areas, each of which is disposed with a plurality of nozzles and is in water communication with a different one of the secondary water diverting orifices of the secondary water diverting member;

the mode switching member comprises a turbine and an eccentric wheel securely engaged and configured to rotate with the turbine relative to the water passage member and the primary water diverting member; a bottom side of the eccentric wheel abuts against and rotates relative to the primary water diverting member the eccentric wheel is disposed with an arc-shaped slot which allows water flow from the water passage orifices to one or more of the primary water diverting orifices of the primary water diverting member;

the eccentric wheel is an eccentric gear wheel; the eccentric gear wheel is partially engaged with an internal gear so as to regulate rotation speed of the eccentric wheel;

the eccentric gear wheel and the internal gear have a same gear ratio.

2. The showerhead as in claim 1, wherein gall water chambers headed by corresponding primary water diverting orifices are defined by spaces occupied by water flowing from the corresponding primary water diverting orifices to the corresponding secondary water diverting orifices to the corresponding water discharge areas.

3. The showerhead as in claim 1, wherein the turbine is disposed with a connecting portion, and the eccentric wheel is disposed with a connecting hole for receiving the connecting portion of the turbine; a pin is disposed inside the connecting portion for connecting the turbine and the eccentric wheel.

4. The showerhead as in claim 1, wherein there are three water passage orifices arranged annually and evenly distributed on the water passage member.

5. The showerhead as in claim 1, wherein the water passage member is disposed with a sealing ring at its outer periphery.

6. The showerhead as in claim 1, wherein the secondary water diverting member is disposed with a sealing ring at its outer periphery.

7. The showerhead as in claim 1, the arc-shaped slot of the eccentric wheel is sized to cover two of the three primary water diverting orifices.

* * * * *